US008468702B2

(12) United States Patent
Doeren

(10) Patent No.: US 8,468,702 B2
(45) Date of Patent: Jun. 25, 2013

(54) UTILITY KNIFE

(75) Inventor: Wolfgang Doeren, Solingen (DE)

(73) Assignee: Martor KG, Solingen (DE)

( * ) Notice: Subject to any disclaimer, the term of this patent is extended or adjusted under 35 U.S.C. 154(b) by 425 days.

(21) Appl. No.: 12/792,193

(22) Filed: Jun. 2, 2010

(65) Prior Publication Data

US 2011/0005087 A1 Jan. 13, 2011

(30) Foreign Application Priority Data

Jul. 8, 2009 (DE) ..... 10 2009 032 362

(51) Int. Cl.
*B26B 1/08* (2006.01)
*B26B 1/00* (2006.01)

(52) U.S. Cl.
USPC ..... 30/162; 30/333; 30/335; 30/163

(58) Field of Classification Search
USPC ..... 30/162, 333, 335, 160
See application file for complete search history.

(56) References Cited

U.S. PATENT DOCUMENTS

| | | | | |
|---|---|---|---|---|
| 4,899,443 | A | 2/1990 | Beermann | |
| 4,936,014 | A * | 6/1990 | Shaanan et al. | 30/162 |
| 2007/0017100 | A1 * | 1/2007 | Gringer et al. | 30/162 |
| 2007/0277382 | A1 | 12/2007 | Okada | |
| 2008/0189956 | A1 | 8/2008 | Polei | |

* cited by examiner

*Primary Examiner* — Andrea Wellington
*Assistant Examiner* — Brendan Ayer
(74) *Attorney, Agent, or Firm* — Andrew Wilford

(57) ABSTRACT

A knife has a pair of housing parts relatively shiftable between an open position and a closed position and a base on one of the housing parts forming a blade seat. A holding arm mounted on the base is movable relative thereto between a blade-holding position retaining a blade in the seat and a blade-change position freeing the blade so that in the blade-change position the blade can be switched. Interengaging formations on the other housing part and on the arm shift the holding arm from the blade-holding position into the blade-change position on movement of the housing parts from the closed position into the open position.

12 Claims, 4 Drawing Sheets

UTILITY KNIFE

FIELD OF THE INVENTION

The present invention relates to a knife. More particularly this invention concerns a utility knife with a retractable blade.

BACKGROUND OF THE INVENTION

A knife is known from U.S. Pat. No. 4,899,443 in which the blade is detachably held between two side parts. The side parts of the blade holder are guided by inner walls. It is not possible to change the blade until the blade holder has been detached from the housing through a rear housing opening. Then the side parts can be separated from one another so that the blade can be removed and another blade can be fitted between the side parts. The blade holder is then inserted into the housing again.

The knife according to US 2008/0189956 has an elongated housing having a front end and formed with a longitudinally extending passage that has a pair of confronting inner surfaces and that opens at the front end. A blade holder is longitudinally shiftable in the passage between a front blade-change position projecting past the front end and a rear position. This holder in turn has a base body with a inner face, and a latch part having a inner face and displaceable relative to the base body between a holding position closely juxtaposed with the base-body inner face and a releasing position spaced from the base-body inner face. An operating element connected to the holder is exposed through the housing for actuation of the holder from outside the housing. A blade between the inner faces of the blade holder is gripped thereby in the holding position of the latch part. The inner surfaces of the housing are spaced and shaped such that they bear inwardly on the latch part and the base body when the blade holder is rearward of the front blade-change position to hold the latch part in the holding position but in the blade-change position allow the latch part to move into the releasing position.

Another knife is known from US 2007/0277382 that has a housing as well as a cover held on the housing in a slidable manner. By sliding the cover into an open position, access to the blade holder located in the rear safety position is possible and the blade held in a blade seat of the blade holder can be removed from a bearing seat of the blade holder.

OBJECTS OF THE INVENTION

It is therefore an object of the present invention to provide an improved utility knife.

Another object is the provision of such an improved utility knife that overcomes the above-given disadvantages, in particular that can be manufactured simply and in which the blade change can be carried out easily whereas the blade is held firmly in the seat during the use of the knife.

SUMMARY OF THE INVENTION

A knife has according to the invention a pair of housing parts relatively shiftable between an open position and a closed position and a base on one of the housing parts forming a blade seat. A holding arm mounted on the base is movable relative thereto between a blade-holding position retaining a blade in the seat and a blade-change position freeing the blade so that in the blade-change position the blade can be switched. Interengaging formations on the other housing part and on the arm shift the holding arm from the blade-holding position into the blade-change position on movement of the housing parts from the closed position into the open position.

According to the invention the blade support formed by the base and the holding arm can be moved, for example between a safety position in which the blade is retracted into the housing in a manner inaccessible to the user, and an extended cutting position in which the blade projects out of the housing. The arm and base of the blade support can typically slide or pivot relative to each other.

As described above, the housing has two parts that are movable relative to one another. The division between the housing parts can be extend for example parallel to a longitudinal axis of the knife. The housing parts can be, for example slidable in a straight-line manner relative to one another. The housing parts can be, for example movable relative to one another in the direction of the housing longitudinal axis. Alternatively, the housing parts can be, for example pivoted relative to one another. The housing can be moved by movement of a first housing part relative to a second housing part between an open position and a closed position. In the open position, access is given to an interior of the housing in which the blade support is arranged. In the closed position, the housing interior is inaccessible to the user. The movement of the housing into the open position can be possible, for example only when the blade support is in the safety position.

A drive device operated by the relative movement of the housing parts between the open position and the closed position moves the parts of the blade support between the blade-holding position and the blade-change position. The closed position of the housing is assigned, for example to the blade-holding position of the blade support and the open position of the housing is assigned, for example to the blade-change position of the blade support.

The drive device is provided in order to relatively move the parts of the blade support on a relative movement of the housing parts. The transmission of movement from the housing to the blade support can take place, for example only on movement from the open position or into the closed position of the housing. Alternatively, movement can be transmitted continuously during the entire movement between the closed position and the open position.

The drive device can comprise, for example a coupling for a detachable movable connection between at least one housing part and at least one holding part of the blade support. Moreover, the drive device can comprise, for example a transmission. Furthermore, the drive device can comprise a converter, with which one type of movement can be converted into another type of movement, e.g. angular movement into straight-line movement or vice versa.

The housing comprises a slide assembly, by means of which at least two housing parts are supported in a longitudinally movable manner against one another between an open position and a closed position. For example, the first housing part has a slide formation that interacts with a second slide formation of the second housing part. The slide assembly can be embodied, for example, as friction bearings. The first slide formation can be guided, for example in a rail-type manner on the second slide formation. The first housing part can be attached to the second housing part in a movable manner by means of the slide assembly. For example, the first slide formation and the second slide formation can be a ridge/groove connection that permits a relative movement between the first holding part and the second housing part. Alternatively, the slide assembly can be formed, for example by a rocker bearing. At least two housing parts are, e g. pivotal relative to one another.

The holding part for the purposes of the invention is, for example a part of the blade support on which a mounting surface for the blade is embodied. For example, the holding part can form a seat for the blade or a part of the seat. At least two holding parts can form the blade seat jointly, for example. In the blade-change position the blade can be fitted to one of the holding parts, for example, and held such that a movement into the closed position of the holding parts is possible without the blade being detached from the preassembly position. A first holding part can be formed, for example by a mounting part slidably supported in the knife housing. A second housing part, for example, can be movably supported on the first housing part. The second holding part can be supported for example in a pivotable manner on the first holding part. According to an alternative, for example the first holding part and the second holding part are supported on a separate mounting part. The first holding part and the second holding part can be supported for example in each case in a pivotable manner on the mounting part.

The advantage of the invention is that the blade change can be carried out particularly easily. As soon as the housing is moved into the open position, the blade can be switched, since during the movement of the housing parts into the open position, the blade-holding parts are automatically moved into the blade-change position in which the old blade can be removed from and a new blade can be inserted into the blade seat. Nevertheless, the blade is held firmly between the holding parts in the blade-holding position of the holding parts. Movement of the housing parts into the closed position automatically shifts the holding parts into the blade-holding position. The risk of injury is furthermore reduced. With some knives from the prior art, the blade change, which was difficult to carry out, often led to injuries.

A first embodiment of the invention is characterized in that the drive device comprises a coupling and that coupling means assigned to at least one of the housing parts interact with coupling means of at least one holding part. First coupling means can be assigned, for example to the first housing part and/or to the second housing part. Second coupling means can be assigned, for example to the first holding part and/or to the second holding part of the blade support. The coupling means can be brought into engagement in a detachable manner. If the coupling means are engaged, a transmission of the movement of at least one knife housing part to at least one holding part of the blade support takes place. If the coupling means are disengaged, no movement is transmitted.

Alternatively, for example for the movement transmission between the housing parts and the holding parts via the drive device can be embodied such that at least one housing part is permanently connected to at least one holding part.

Another embodiment is characterized in that the drive device comprises a transmission. The transmission for example can convert movement of at least one housing part into movement of at least one holding part. For example, a certain long movement of one of the housing parts can be converted into a shorter movement of one of the holding parts. For example, a transmission of the distance covered, the movement speed, or the is actuating force can take place.

Another embodiment of the invention is characterized in that the drive device comprises a converter for converting the movement of at least one housing part into another movement of at least one holding part. For example, with a converter a straight-line relative movement of the housing parts can be converted into a swivel movement of the holding parts.

According to a further embodiment, a first holding part is embodied as a lever with at least one lever arm. The lever can be supported, for example pivotally on a mounting part of the blade support, which mounting part is supported in the knife housing in a movable manner between the safety position and the cutting position. The blade can be held in the blade-holding position, for example between a mounting surface of the lever arm and a mounting surface of the second holding part.

The mounting part can form the second holding part. The mounting part can form, for example at least one part of a mounting seat for the blade. A preinstallation of the blade, for example, can be possible on the mounting part in the blade-change position. At least one lever arm of the lever can be, for example part of the drive device by means of which the drive of the movement of the lever between the blade-holding position and the blade-change position takes place.

According to a further embodiment, at least one lever arm of the lever forms a part of the drive device. At least one lever arm can be for example part of the coupling and/or part of the converter and/or part of the transmission device.

Movement of the first housing part or of the second housing part can be transmitted, for example to a lever arm. The straight-line movement of the housing part can be converted, for example into rotation of the lever. For this purpose, the housing part can be brought into engagement with a lever arm and pivot the lever arm with the movement between the open position and the closed position.

The lever can comprise a bearing pin that is supported in a journal or bearing seat of the mounting part. The pivot pin can be formed, for example on the two-arm lever. The pivot pin can be, for example slidably supported in the bearing seat of the mounting part.

The pivot pin forms a click-stop connection, for example with the bearing seat. The mounting part forming the bearing seat can be formed for example such that the pivot pin can be moved only by elastic deformation of the mounting part in the mounting seat. A specific assembly force is necessary for the elastic deformation, which assembly force is determined, for example by the structure such that a simple assembly is possible and the pivot pin is held firmly in the bearing seat during use of the knife. In this manner, the lever can be mounted very easily onto the base.

According to a further embodiment, a latch is provided on the housing that can be moved between a latched position and an unlatched position. Relative movement of the housing parts is prevented in the latched position and relative movement of the housing parts is possible in the unlatched position. The latch can move, for example in the closed position, automatically into the latched position. Spring means can urge, for example the latch into the latched position.

For example, the latch comprises a push button attached to one of the housing parts. The push button can be arranged, for example in the latched position in the movement path and in the unlatched position outside the movement path of the other housing part. The push button can be movable, for example approximately transversely to the longitudinal direction of relative movement of the housing parts. The push button can be, for example movably attached to the second housing part and in the latched position engage through an opening in the first housing part. The push button can be moved, for example out of the movement path of the first housing part by a movement into the unlatched position so that the first housing part is unlocked.

According to a further embodiment, the first housing part and the second housing part are separated from each other essentially along a division extending parallel to a longitudinal central axis of the housing. The movement into the open position can then be carried out particularly easily in an ergonomic manner.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
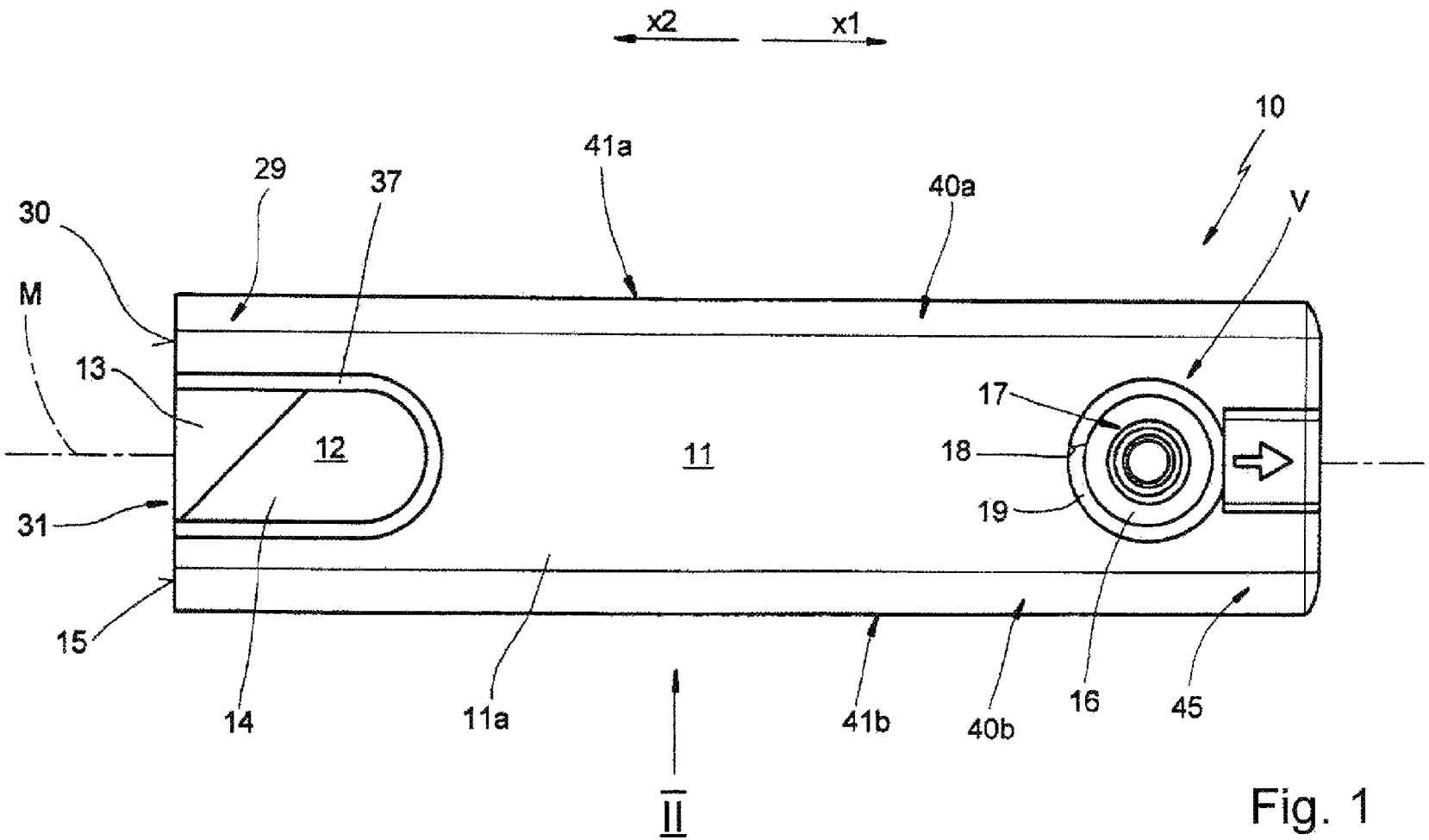
FIG. 1 is a side view of the knife according to the invention with the blade in the rear position and the housing closed.

As seen in FIG. 1 a utility knife 10 according to the invention has a housing 11 and a blade support 12. A blade 13 is held by the blade support 12. The blade support 12 is provided with a grip formation 14 by means of which the blade support 12 can be moved from the FIG. 1 rear safety position 1 in which the blade 13 is retracted into the housing 11 and is inaccessible to the user on forward displacement in the direction x2 into a cutting position in which a tip of the blade 13 projects through an opening 31 of the housing 11 and beyond a front edge 15 of the housing 11. The cutting position of the blade support 12 is not shown in the drawing.

The housing 11 is provided on both sides of the knife with cutouts 37 of which only one is shown in FIG. 1. Actuation of the grip formation 14 is also possible in the safety position of the blade support 12 via the cutouts 37. The blade 13 cannot be changed in the safety position or in the unillustrated cutting position of the blade support 12 if the housing 11 is in the closed position of FIG. 1.

Figure 2:
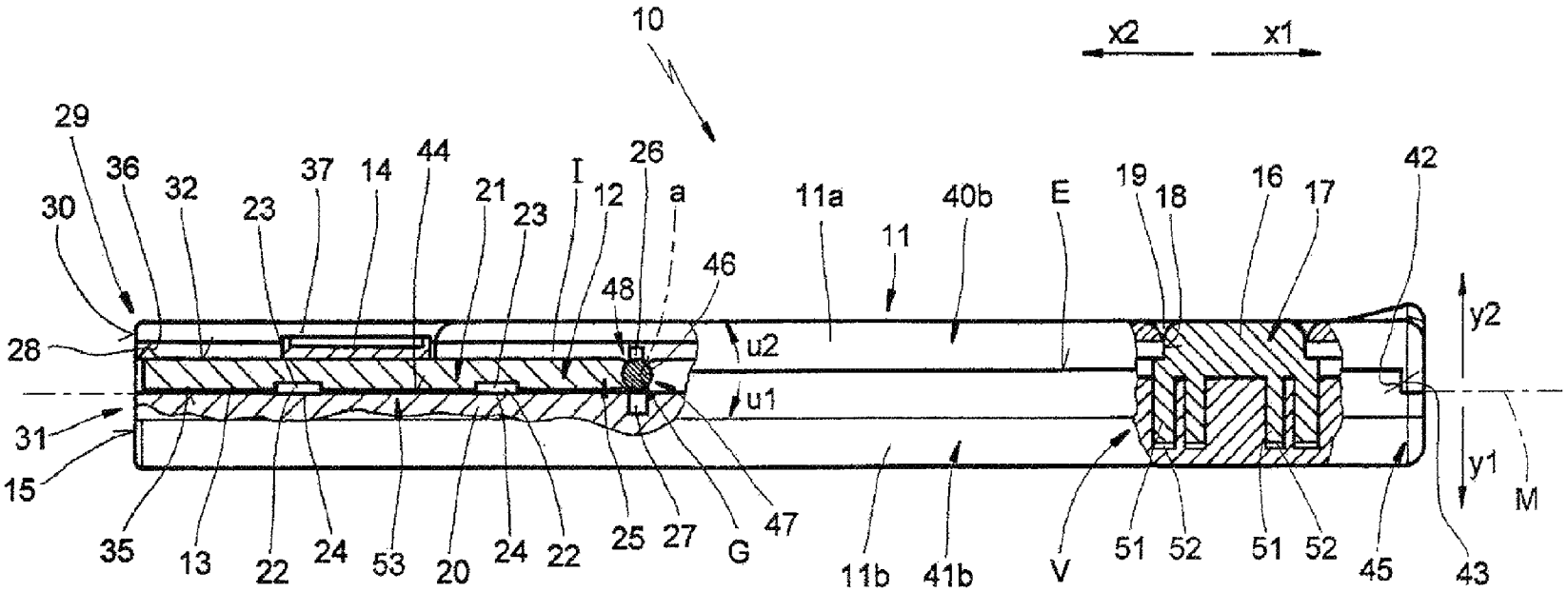
FIG. 2 is a partly sectional view taken in the direction of arrow II of FIG. 1.

As shown in FIG. 2, the housing 11 has a first housing part 11*a* and a second housing part 11*b* joined at a plane E extending approximately parallel to a longitudinal central axis M of the housing 11. The first housing part 11*a* is longitudinally slidable on the second housing part 11*b* via a slide assembly L shown only in FIG. 3. The slide assembly L is formed by a first slide formation 38 on the first housing part 11*a* as well as complementary second slide formation 39 on the second housing part 11*b*. Here, the first slide formation 38 is a pair of longitudinally extending and outwardly projecting ridges formed on the outside on sides 40*a* and 40*b* of the first housing part 11*a*. The second slide formation 39 is a pair of complementary is grooves formed on inner surfaces of sides 41*a* and 41*b* of the housing part 11*b* facing toward an interior I of the housing 11. The first slide formation 38 extends the entire length of side regions 40*a* and 40*b* of the first housing part 11*a*. The second slide formation 39 similarly extend the entire length of side regions 41*a* and 41*b* of the second housing part 11*b*. Alternatively, the first slide formation 38 and the second slide formation 39 can be provided in a manner not shown in some sections in one or more regions of the housing 11.

Mounting the first housing part 11*a* on the second housing part 11*b* is carried out in that a front end 29 of the first housing part 11*a* is fitted to a rear end 45 of the second housing part 11*b* with the first slide formation 38 fitting into the second slide formation 39. Subsequently, the first housing part 11*a* is moved forward relative to the second housing part 11*b* in the direction x2 approximately parallel to the longitudinal central axis M of the housing 11. When a stop face 42 of the first housing part 11*a* strikes a shoulder 43 of the second housing part 11*b*, the housing parts 11*a* and 11*b* are in the closed position shown in FIGS. 1 and 2.

In the closed position, a latch V formed as a click-stop device that can be moved between a latched position and an unlatched position, moves out of the unlatched position into the latched position. Unillustrated spring means urge the latch V into the latched position. The latch V has a push button 16 attached to the second housing part 11*b* as well as a hole 19 in the first housing part 11*a*. The push button 16 has two coaxially cylindrical collars 51 that are slidable in complementary annular grooves 52 of the second housing part 11*b*. This interfit ensures movement of the push button 16 relative to the second housing part 11*b* in transverse directions y1 and y2 perpendicular to the longitudinal directions x1 and x2.

In the closed position of the housing 11 according to FIGS. 1 and 2, the first housing part 11*a* and the second housing part 11*b* are locked to one another. The push button 16 according to FIG. 2 is in the latched position. The latching is the result of a cylindrical head 17 of the push button 16 engaging through the hole 19 in the first housing part 11*a* and is thereby engaging an edge 18 of the hole 19. The unillustrated spring urge the push button 16 outward in the transverse direction y2 into the latched position. Relative movement of the first housing part 11*a* relative to the second housing part 11*b* is thus prevented.

Figure 3A:
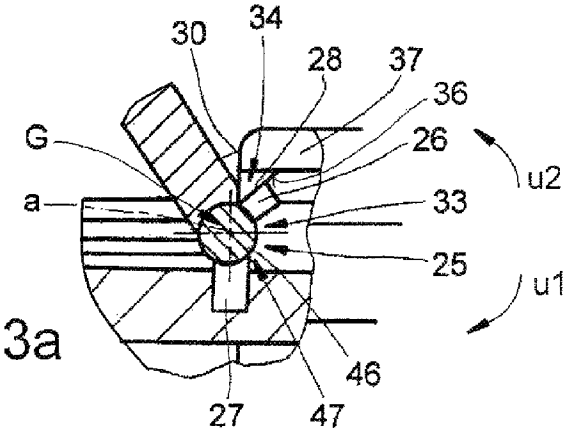
FIG. 3*a* is a large-scale view of the detail indicated at IIIa in FIG. 3.
Figure 3:
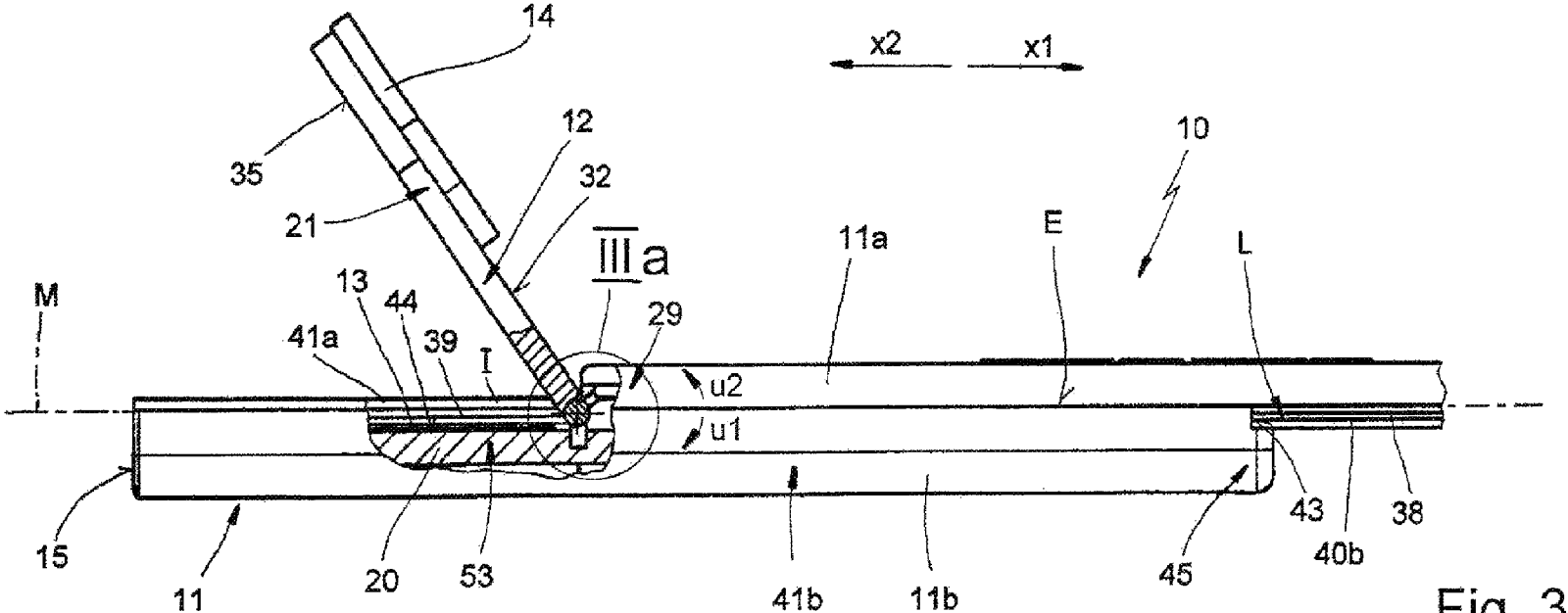
FIG. 3 is a view like FIG. 2 but with the housing open and the blade support in the blade-change position.

The first housing part 11*a* can be moved relative to the housing part 11*b* out of the closed position shown in FIGS. 1 and 2 in direction x1 into the open position according to FIG. 3, when the push button 16 is pressed transversely inward against the spring force in the direction y1 into the unillustrated unlatched position in which it is clear of the hole 19. As soon as the head 17 is out of path of the sidewall 18, the first housing part 11*a* can slide relative to the second housing part 11*b* in the rearward longitudinal direction x1 into the open position. Unillustrated detachable blocking means can, for example prevent the housing part 11*a* from being moved relative to the housing part 11*b* in the direction x1 into the open position.

According to FIG. 2, the blade support 12 comprises a base 20 as well as a lever 25 with a holding arm 21. The lever 25 is can rotate on the base 20 at a pivot G formed by a pivot pin 46 of the lever 25 and a journal 47 formed in the base 20 and receiving the pin. The pivot pin 46 can rotate about the geometric pivot axis a in the journal or seat 47.

In FIG. 2 the holding arm 21 is located in the blade-holding position in which it is firmly held between a seat face 44 of the base 20 and a blade holding face 35 of the holding arm 21 in a blade seat 53 of the base 20. For positive securing of the blade 13, pins 22 are formed on the base 20 and engage in respective recesses 23 of the holding arm 21. The pins 22 thereby engage through holes 24 in the blade 13.

The holding arm 21 can be moved into a blade-change position according to FIG. 3 by pivoting the holding arm 21 about the pivot axis a in the opening direction u1. In the blade-change position, the blade 13 can be removed and a blade 13 inserted into the blade seat 53 of the blade support 12. The lever 25 can be pivoted from the blade-change position shown in FIG. 3 in the closing direction u2 into the blade-holding position according to FIG. 2 with the holding arm 21.

In the closed position of the housing parts 11*a* and 11*b*, the holding arm 21 and the base 20 are in the blade-holding position and are held in the closed position by the confronting faces of the housing parts 11*a* and 11*b* facing toward the housing interior I.

Figure 4:
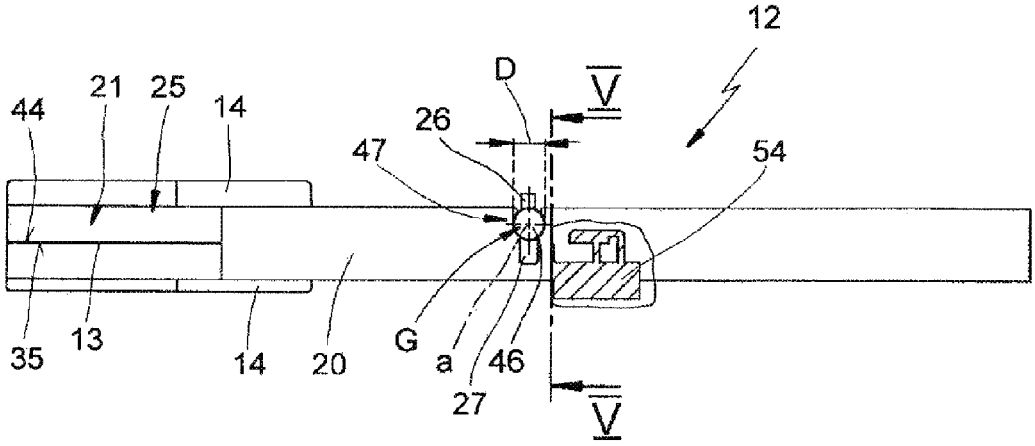
FIG. 4 is a partly sectional side view of the blade support.
Figure 5:
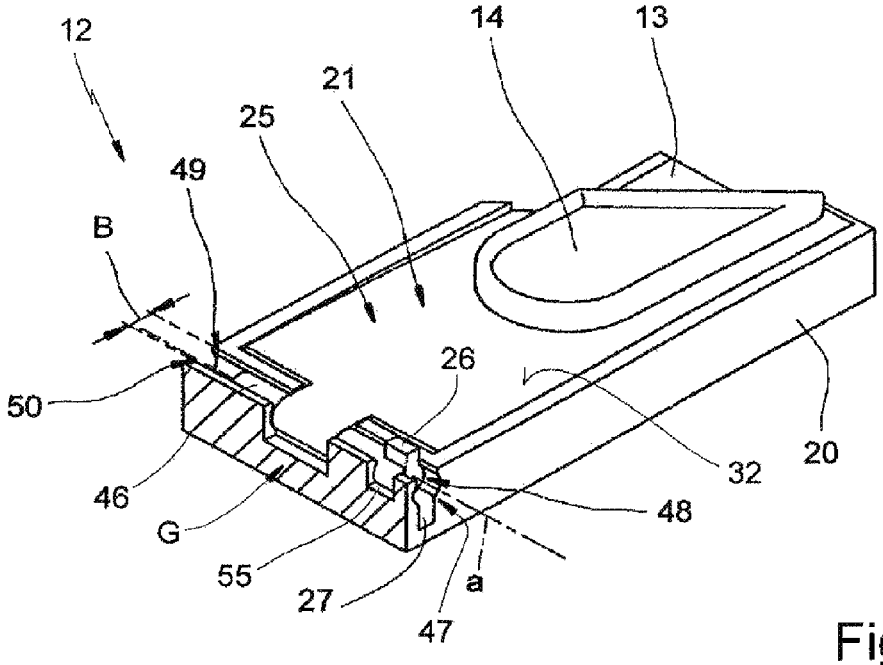
FIG. 5 is a perspective sectional view along plane V-V of FIG. 4.

The blade support 12 is shown separately in FIG. 4. A groove 27 formed in the base 20 permits a snap-in mounting of the pivot pin 46 in the bearing seat 47. Elastic deformation of the base 20 is made possible by the groove 27 that opens radially into the seat 47. Elastic deformation of the base 20 allows walls 49 and 50 (see FIG. 5) adjoining an opening 48 to yield elastically during installation of the pivot pin 46 as the pivot pin 46 passes through a narrow mouth 48 (FIG. 5) of the bearing seat 47. since a diameter D of the pivot pin 46 is greater than a width B of the opening 48. As soon as the pivot pin 46 is in the bearing seat 47, the walls 49 and 50 return elastically to their starting position and the pin 46 is retained.

FIG. 4 shows an element or hook 54 formed on the base 20 for attachment of a spring (not shown). A second attachment element or hook (not shown) is provided on the housing 11. An unillustrated spring tensioned between these elements urges the blade support 12 into the safety position.

The holding arm 21 forms a first lever arm of the two-arm lever 25. A short second lever arm 26 of the lever 25 extends in the blade-holding position of the blade holder 12 according to FIG. 2 into the movement path of a shoulder 28 of the first housing part 11*a*. The shoulder 28 is on the front end 29 of the first housing part 11*a*, facing toward the interior I of the housing 11. The extension 26 and the shoulder 28 can be brought into engagement with each other to form a first coupling 33.

The blade 13 is changed as follows: After actuation of the push button 16, the first housing part 11*a* can be slid relative to the second housing part 11*b* in the rearward direction x1 from the closed position of FIGS. 1 and 2 to the open position of FIG. 3. During movement of the housing 11 from the closed position into the open position, a back face 36 of the shoulder 28 of the first housing part 11*a* comes into contact with the extension 26 of the blade support 12.

On further movement of the housing 11 into the open position, the first housing part 11*a* and the extension 26 are coupled to each other. Torque is exerted around the axis of rotation a so that the lever 25 with the holding arm 21 pivots in the direction u1 into the blade-change position of FIG. 3, fitting the arm 26 into (see FIG. 5) a notch 55 formed in the base 20. Pivoting of the holding arm 21 is possible as soon as the housing surface of the housing part 11*a* facing toward the interior I no longer holds the holding arm 21 in the blade-holding position.

If after the blade change has been carried out, the first housing part 11*a* is displaced forward in direction x2 relative to the second housing part 11*b*, an end face 30 of the first housing part 11*a* comes into contact with an outer face 32 of the holding arm 21 and exerts a force on the holding arm 21. As a result, during the movement of the housing from the open position into the closed position the holding arm 21 is pivoted about the pivot axis a in the direction u2 into the blade-holding position. In the blade-holding position the blade 13 is firmly held between the base 20 and the holding part 21. The outer surface 32 and the outer surface 30 form a second coupling 34.

As soon as the first housing part 11*a* is in the closed position relative to the second housing part 11*b*, the push button 16 snaps into the hole 19 again according to FIG. 2 and locks the first housing part 11*a* to the second housing part 11*b*.

It should also be pointed out that the extension 26 and the shoulder 28 form a first motion converter by means of which straight-line movement of the first housing part 11*a* relative to the second housing part 11*b* can be converted into a rotary moment of the holding part 21 relative to the base 20. The outer surface 30 of the housing part 11*a* and the outer surface 32 of the holding arm 21 form a second converter, by means of which straight-line movement of the first housing part 11*a* relative to the second housing part 11*b* can be converted into rotary movement of the holding part 21 relative to the base 20.

I claim:

1. A knife comprising:

a pair of housing parts relatively shiftable between an open position and a closed position, the housing parts being engaged with each other in both the open and closed positions;

a base on one of the housing parts forming a blade seat;

a blade fittable in the seat;

a holding arm mounted on the base and movable relative thereto between a blade-holding position retaining the blade in the seat and a blade-change position freeing the blade, whereby in the blade-change position the blade can be switched; and interengaging formations on the other housing part and on the arm for shifting the holding arm between the blade-holding position and the blade-change position as a result of movement of the housing parts between the closed position and the open position.

2. The knife defined in claim 1 wherein the interengaging formations also shift the holding arm from the blade-change position into the blade-holding position on movement of the housing parts between the open position and the closed position.

3. The knife defined in claim 1 wherein the base and holding arm are shiftable relative to the housing parts between a retracted position with the blade contained between the housing parts and an extended position with the blade projecting forward from the housing parts.

4. The knife defined in claim 1 wherein the housing is elongated and extends along a longitudinal axis, the two parts being movable only longitudinally relative to each other.

5. The knife defined in claim 4 wherein the arm is pivotal about an axis extending generally perpendicular to the longitudinal axis on movement between the blade-change and blade-holding positions.

6. The knife defined in claim 5 wherein the arm is one arm of a two-arm lever having another arm forming the formation of the holding arm and engageable with the formation of the other housing part.

7. The knife defined in claim 6 wherein the housing parts are of substantially the same length and the front end of the other housing part forms the respective formation.

8. The knife defined in claim 7 wherein the formation of the one housing part is a ridge on the front end, directed toward the other housing part, and having a rear face engageable with the other arm of the lever.

9. The knife defined in claim 4 wherein the housing parts are formed with interengageable longitudinally extending slide formations.

10. The knife defined in claim 4, further comprising means for releasably retaining the housing parts in the closed position.

11. The knife defined in claim 10 wherein the means includes a transversely shiftable latch member.

12. The knife defined in claim 4 wherein in the closed position the base part and holding arm are largely contained between the housing parts.

* * * * *